US010026343B2

(12) United States Patent
Kim

(10) Patent No.: US 10,026,343 B2
(45) Date of Patent: Jul. 17, 2018

(54) MULTIFUNCTIONAL WINDOW/DOOR AND BUILDING HAVING WALL CONFIGURED USING SAME

(71) Applicant: Jae-Sik Kim, Daegu (KR)

(72) Inventor: Jae-Sik Kim, Daegu (KR)

( * ) Notice: Subject to any disclaimer, the term of this patent is extended or adjusted under 35 U.S.C. 154(b) by 0 days.

(21) Appl. No.: 15/502,962

(22) PCT Filed: Aug. 11, 2014

(86) PCT No.: PCT/KR2014/007425
§ 371 (c)(1),
(2) Date: Feb. 9, 2017

(87) PCT Pub. No.: WO2016/024645
PCT Pub. Date: Feb. 18, 2016

(65) Prior Publication Data

US 2017/0236458 A1 Aug. 17, 2017

(51) Int. Cl.
*G09F 11/24* (2006.01)
*G09F 11/26* (2006.01)
(Continued)

(52) U.S. Cl.
CPC ..... *G09F 9/302* (2013.01); *G09F 11/025* (2013.01); *G09F 11/10* (2013.01); *G09F 11/24* (2013.01);
(Continued)

(58) Field of Classification Search
CPC ..... E06B 2009/2405; E06B 2009/2452; E06B 2009/405; E06B 2009/6845;
(Continued)

(56) References Cited

U.S. PATENT DOCUMENTS 4,104,810 A * 8/1978 Mirman ..... G09B 1/24 40/518
4,813,198 A * 3/1989 Johnston ..... B60J 1/2041 160/241
(Continued)

FOREIGN PATENT DOCUMENTS

DE 2242444 A1 * 3/1973 ..... G09F 11/29
EP 1482472 A1 * 12/2004 ..... G09F 11/21
(Continued)

OTHER PUBLICATIONS

PCT/KR2014/007425 International Search Report dated Apr. 30, 2015.

*Primary Examiner* — Ryan D Kwiecinski
(74) *Attorney, Agent, or Firm* — Wagenknecht IP Law Group PC

(57) ABSTRACT

A multipurpose advertisement board comprising: a window; a vertical film comprising multiple film strips connected in series; a first image expression device comprising an operating unit rotatably connected to a vertical winding roller in upper and lower portions of the frame that vertically move the vertical film to display the multiple film strips in order; a horizontal film comprising multiple film strips connected in series; a second image expression device installed on the window frame, wherein the second image expression device comprises an operation unit rotatably connected to a horizontal winding roller installed in left and right portions of the window frame to rotate or release the horizontal film, thereby horizontally moving the horizontal film so that the multiple film strips of the horizontal film overlap with the film strips of the vertical film to make a combined image.

4 Claims, 5 Drawing Sheets

(51) Int. Cl.

| | |
|---|---|
| ***G09F 19/22*** | (2006.01) |
| ***G09F 9/302*** | (2006.01) |
| ***G09F 11/02*** | (2006.01) |
| ***G09F 11/10*** | (2006.01) |
| *E06B 9/40* | (2006.01) |
| *E06B 9/68* | (2006.01) |

(52) U.S. Cl.
CPC ..... *G09F 11/26* (2013.01); *G09F 19/226* (2013.01); *E06B 2009/405* (2013.01); *E06B 2009/6845* (2013.01)

(58) Field of Classification Search
CPC ..... E06B 2009/6881; E06B 9/70; E06B 9/72; G09F 2011/0863; G09F 11/21; G09F 11/24; G09F 11/29; G09F 11/18; G09F 11/26; G09F 11/28; G09F 11/295; G09F 19/226
USPC ..... 40/471, 518; 160/241
See application file for complete search history.

(56) References Cited

U.S. PATENT DOCUMENTS 5,072,533 A * 12/1991 Heinz ..... G09F 11/18 40/471
5,467,266 A * 11/1995 Jacobs ..... B60J 1/2016 160/1
5,530,571 A * 6/1996 Chen ..... G02B 6/0051 349/112
6,178,674 B1 * 1/2001 Decaux ..... G09F 11/21 40/467
6,427,750 B1 * 8/2002 Butler ..... E06B 9/42 160/122
6,848,491 B2 * 2/2005 Gambarelli ..... B65G 1/02 160/122
8,069,597 B2 * 12/2011 Kim ..... G09F 11/21 40/471
2006/0150452 A1 * 7/2006 Chen ..... G09F 11/18 40/471
2006/0236572 A1 * 10/2006 Ko ..... G09F 11/29 40/478
2007/0195514 A1 * 8/2007 Katz ..... G09F 13/04 362/97.1
2010/0186272 A1 * 7/2010 Ophoff ..... G09F 11/295 40/467
2012/0193041 A1 * 8/2012 Sun ..... E06B 9/44 160/241
2013/0139976 A1 * 6/2013 Carvallo ..... E06B 9/264 160/90
2015/0059219 A1 * 3/2015 Remenda ..... G09F 11/21 40/518
2016/0222726 A1 * 8/2016 Rupel ..... E06B 9/66

FOREIGN PATENT DOCUMENTS

FR 2852137 A1 * 9/2004 ..... G09F 11/29
KR 20-1998-0022913 U 7/1998
KR 10-2006-0091054 A 8/2006
KR 10-0867932 B1 11/2008
KR 10-1112013 B1 2/2012
KR 101112013 B1 * 2/2012

* cited by examiner

[Fig. 1]
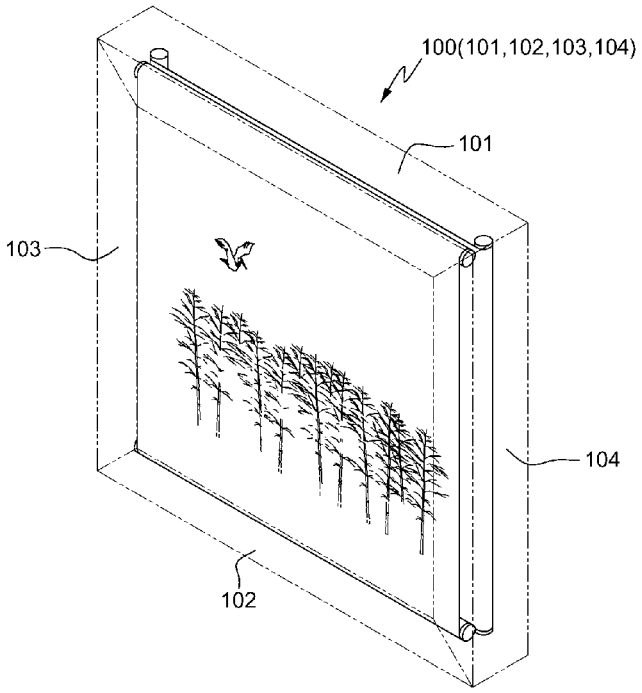
[Fig. 2]
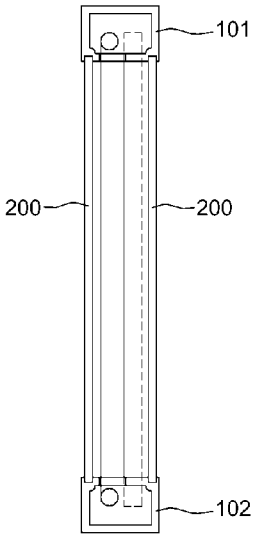
[Fig. 3]
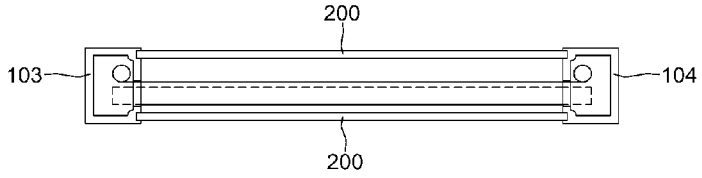

[Fig. 4]
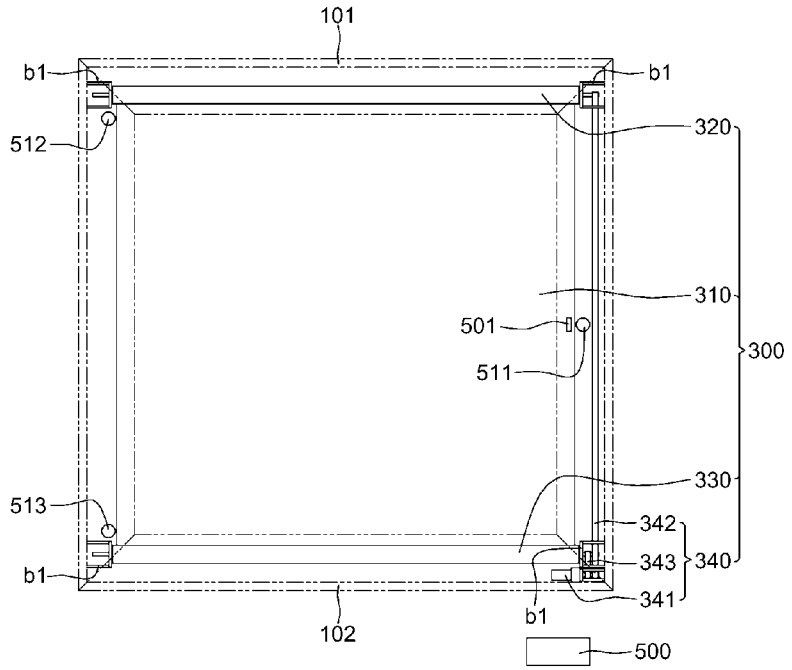
[Fig. 5]
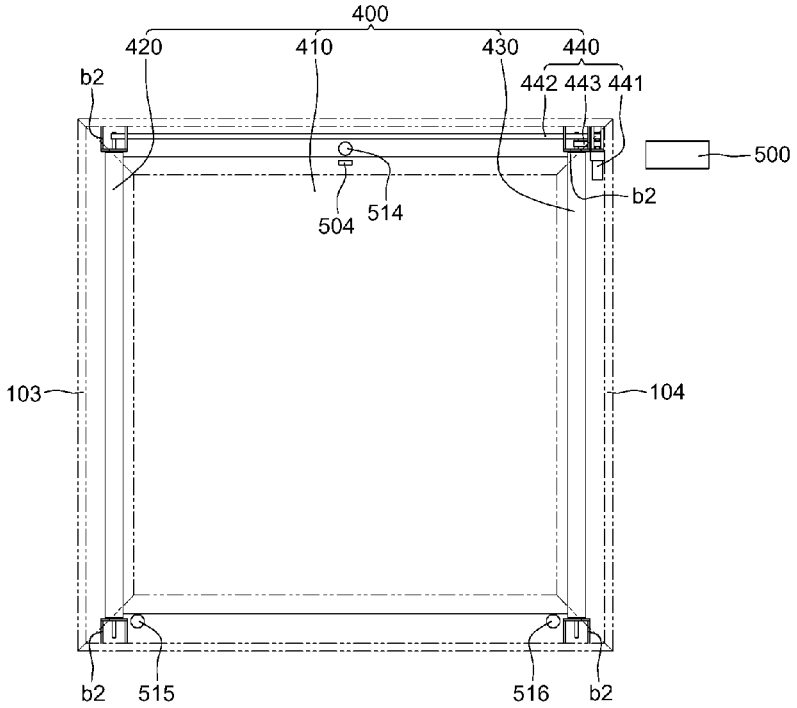

[Fig. 6]
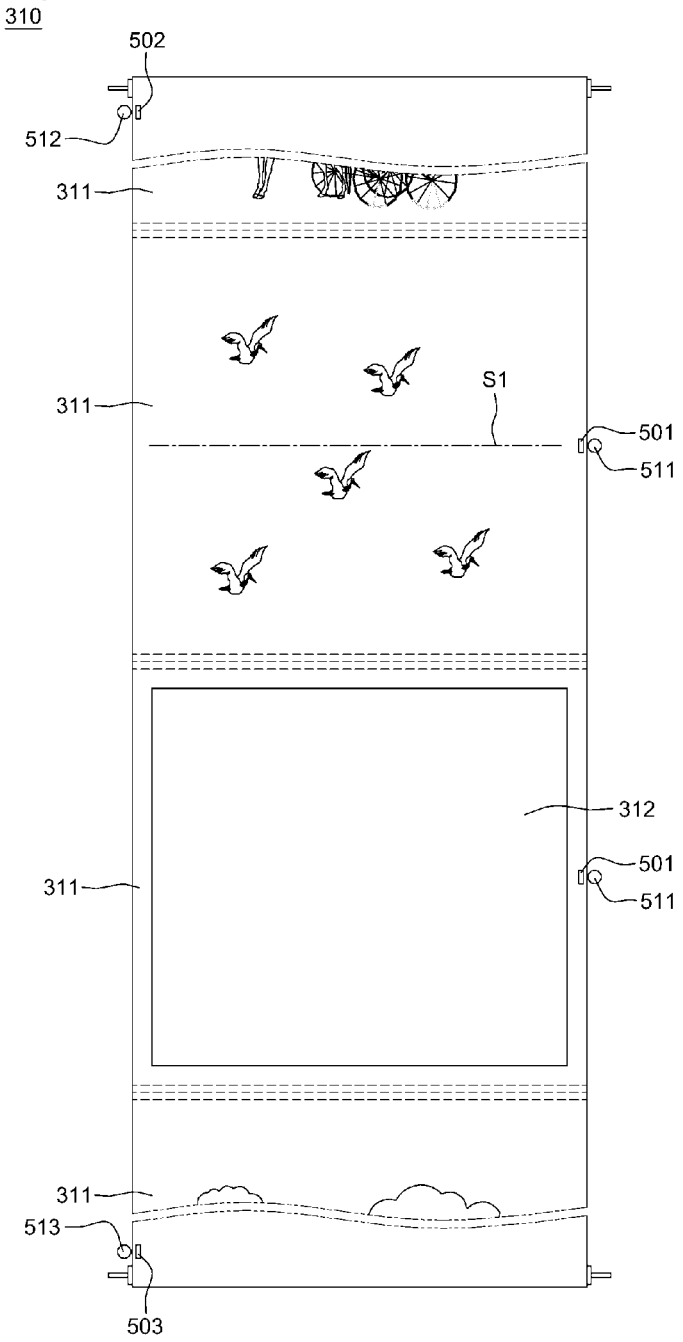

[Fig. 7]
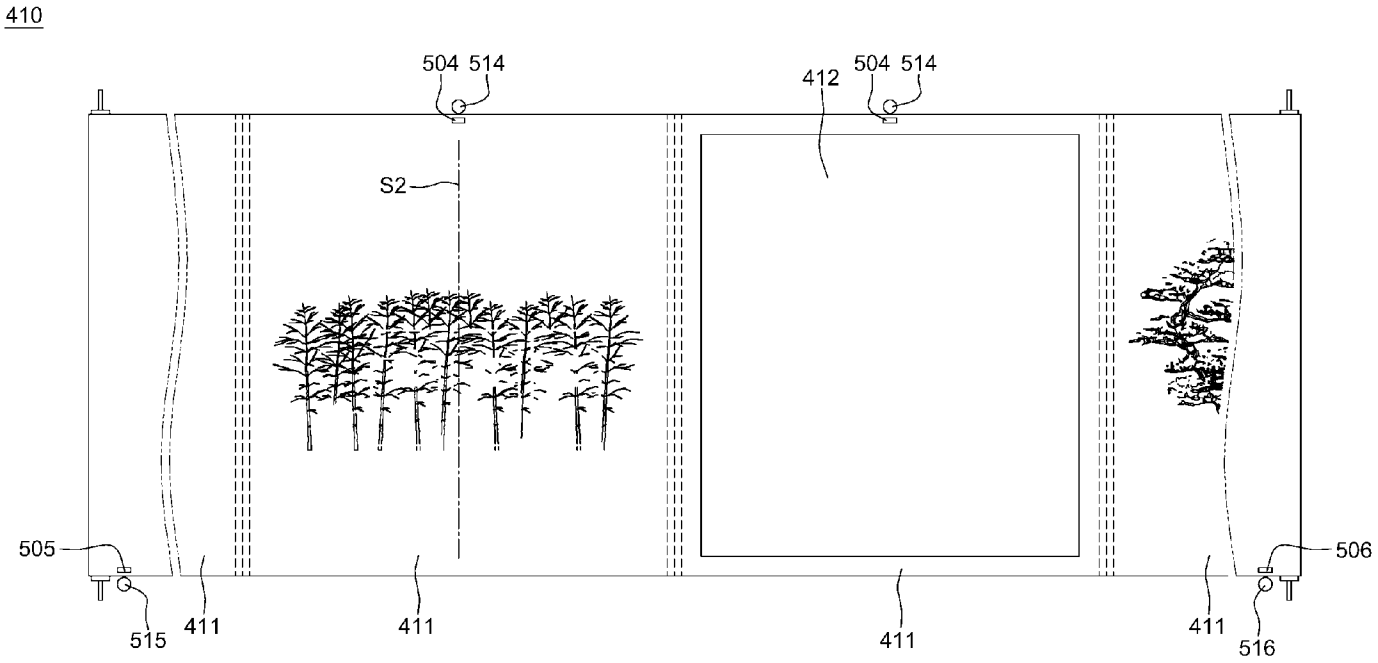

[Fig. 8]
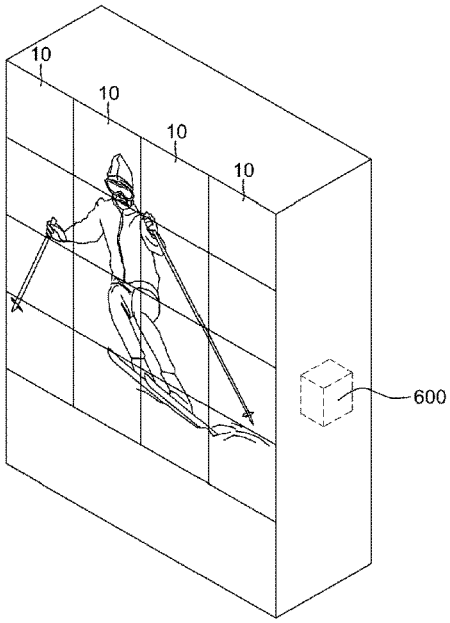
[Fig. 9]
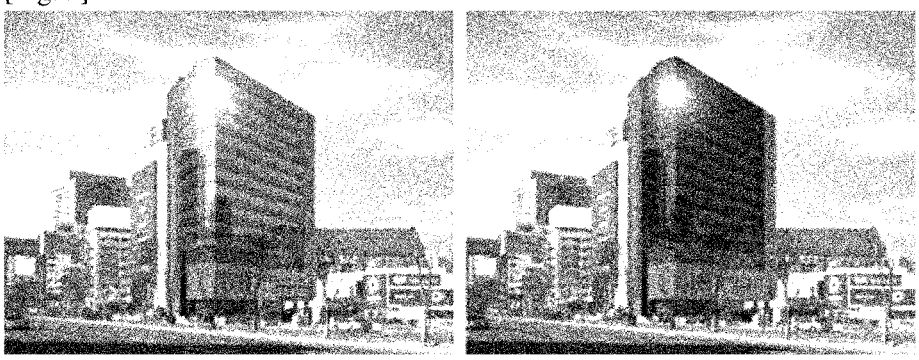
[Fig. 10]
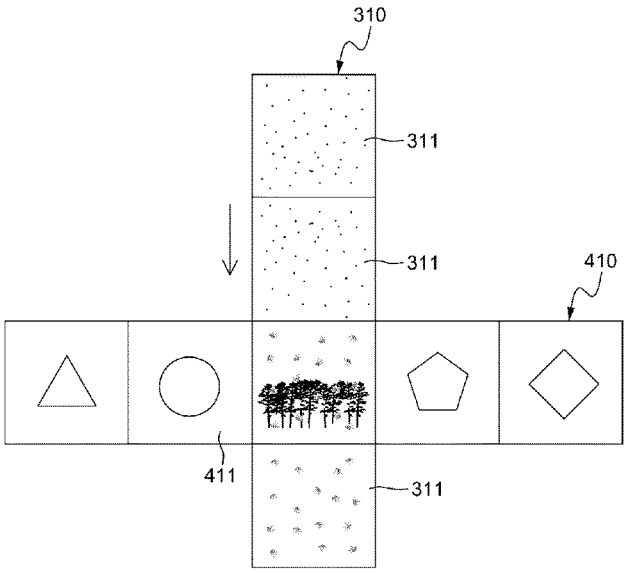

MULTIFUNCTIONAL WINDOW/DOOR AND BUILDING HAVING WALL CONFIGURED USING SAME

CROSS REFERENCE TO RELATED APPLICATIONS

This is a US national phase application under 35 U.S.C. § 371 of international patent application no. PCT/KR2014/007425, filed 11 Aug. 2014; the entire content of which is herein incorporated by reference in its entirety.

TECHNICAL FIELD

The present invention relates to buildings with a multipurpose advertisement board having two films (one vertical; one horizontal) crossing to make various colors and images in the window on a wall of a building.

BACKGROUND ART

In general, buildings have various windows and doors installed in openings to separate the interior from the exterior.

On the one hand, the most common form of windows and doors installed in the wall of a building is to install a window frame in the structure and to install a glass window in the frame to separate the interior from the exterior. Commonly, the glass window is either fixed in the frame or positioned in the frame so that it moves to open and close.

To control the amount of sunlight that comes through windows, curtains, blinds, or roll screens are often installed, but this requires extra space and cost.

Still further, images of a particular product or company can be attached on the window for advertising purposes, but there are disadvantages such as the difficulty of changing the images and the loss of a clear view due to the attached images.

In the consideration of these issues, I previously invented a multipurpose advertisement board using a window, now U.S. Pat. No. 8,069,597 B2. This previous multipurpose advertisement board included winding rollers at the upper end and the lower end of the frame, and a film having multiple images. Such a multipurpose advertisement board has an advantage that it can display multiple images by simply rolling one of the rollers to wind the film, without a complicated preparation. However, such multipurpose advertisement board has a restricted advertising effect as it can only display a number of images in order. It cannot change the color of the image to adapt to the weather or the surroundings, or put dynamics to the image.

OBJECT OF THE INVENTION

The present invention has been devised in consideration of the aforementioned problems and situations, the objective of the present invention is to provide buildings with multipurpose advertisement boards that have two films between two glass plates within a window frame that move in different directions to display various images by intersecting one another.

BRIEF SUMMARY OF THE INVENTION

To achieve the objectives mentioned above the present invention includes a window frame with more than one glass plate attached to the window frame; a vertical film that comprises multiple first film strips connected in series; vertical winding rollers that move the vertical film to display the multiple vertical film strips in order, which are united with the vertical film and installed in the upper and lower frame of the window frame mentioned above; an image expression device, installed in the upper window frame, comprising an operation unit combined with the vertical winding rollers to rotate them; a horizontal film comprising multiple horizontal film strips connected in series; a horizontal winding roller installed in the left and right frame of the window frame mentioned above, combined with the horizontal film to rotate or release the horizontal film to make it move horizontally so that multiple horizontal film strips overlap with the vertical film strips of the vertical film to make a combined image; an image expression device that is installed on the aforementioned window frame and comprises the horizontal winding rollers and an operation unit combined with the horizontal winding rollers; an empty part, as one of the many vertical film strips, allowing light that comes in through the window without disruption by the vertical film to fill an area bigger than or equal to the area of the glass plate; and an empty part, as one of the many horizontal film strips, allowing light that comes in through the window without disruption by the horizontal film to fill an area bigger than or equal to the area of the glass plate. By overlapping the empty parts of the vertical film and the horizontal film, the multipurpose advertisement board can achieve a clear view for the users and influx of sunlight regardless of the vertical film and the horizontal film.

Also the present invention provides a multipurpose advertisement board that involves a motor controlled unit comprising a first operation unit and a second operation unit that delivers rotary power to rotate the winding rollers, and a control unit that controls the first operation unit and the second operation unit to change the color of the combined image or to add animated effects on the combined image by changing either both or one of the film strips that overlap.

Also, the present invention provides a multipurpose advertisement board comprising: multiple first vertical position markers installed on the center of each vertical film strip located either on the left or the right of the vertical film mentioned above; a second vertical position marker installed on the upper part of the vertical film, located either on the left or the right of the vertical film that the first vertical position marker is not on; a third vertical position marker installed on the lower part of the vertical film on the same side as the second vertical position marker; a first sensor that signals when it recognizes the first vertical position marker as the film strip is on the right location within the window frame, installed on the window frame; a second sensor that signals when it recognizes the second vertical position marker as the vertical film is completely unrolled by the vertical winding roller, installed on the window frame close to the lower part of the vertical winding roller; a third sensor that signals when it recognizes the third vertical position marker as the vertical film is completely unrolled by the vertical winding roller, installed on the window frame close to the upper part of the vertical winding roller; multiple first horizontal position markers installed on the center of each horizontal film strip, located either on the upper or the lower part of the horizontal film mentioned above; a second horizontal position marker installed on the left side of the horizontal film, located either on the upper or the lower part of the horizontal film that the first vertical position marker is not on; a third horizontal position marker installed on the right side of the horizontal film on the same side as the second vertical position marker; a fourth sensor that signals when it recognizes the first horizontal position marker as the horizontal film strip is on the right location within the window frame, installed on the window frame; a fifth sensor that recognizes the second horizontal position marker as the horizontal film is completely unrolled by the horizontal winding roller, located on the window frame close to the right side of the horizontal winding roller; a sixth sensor that signals when it recognizes the third horizontal position marker as the horizontal film is completely unrolled by the horizontal winding roller, installed on the window frame close to the left side of the Horizontal winding roller.

Also, the present invention installs a plurality of the aforementioned multipurpose advertisement boards, and the images of each board are combined to embody a whole complete image and an integrated controller that can control the whole image by controlling each of the advertisement boards, and buildings with walls with these boards.

Using the present invention with the aforementioned characteristics, one can increase the advertising effect by changing the color depending on the weather or the surrounding environment.

Also, by animating the images of each multipurpose advertisement board, one can make animated effects on the images.

BRIEF DESCRIPTION OF THE DRAWINGS

FIG. 1 is a perspective view of the structure of the multipurpose advertisement boards when implemented desirably according to the present invention.

FIG. 2 is a side view of the structure of the multipurpose advertisement boards when implemented desirably according to the present invention.

FIG. 3 is a plan view of the structure of the multipurpose advertisement boards when implemented desirably according to the present invention.

FIG. 4 is a front view of the structure of the first image expression device according to the present invention.

FIG. 5 is a front view of the structure of the second image expression device according to the present invention.

FIG. 6 is a front view of the structure of the vertical film according to the present invention.

FIG. 7 is a front view of the structure of the vertical film according to the present invention.

FIG. 8 is an example of a building with a side of wall consisting of the multipurpose advertisement boards according to the present invention.

FIG. 9 shows a building with a changed exterior/atmosphere by changing the color of the image created by the overlap of the vertical film and the horizontal film.

FIG. 10 shows the image created by the overlap with animated effects.

DETAILED DESCRIPTION OF THE INVENTION

The following is a detailed explanation of a desirable implementation of the present invention concerning the attached drawings. In explaining the present invention, a detailed explanation of related functions and composition is omitted when judged it would unnecessarily disrupt the point of the present invention. A multipurpose advertisement board of the present invention has a window frame 100, a glass plate 200, a first image expression device 300; and a second image expression device 400.

The aforementioned window frame 100 has an upper part frame 101, a lower part frame 102, a left frame 103, and a right frame 104. The upper part frame 101 and lower part frame 102 are arranged in a horizontal structure and separate from each other, the left frame 103 is installed to connect the left side of the upper part frame 101 and the lower part frame 102, and the right frame 104 is installed to connect the right side of the upper part frame 101 and the lower part frame 102.

The window frame 100 can be additionally installed on the structure of a building to constitute a window, or use a part of a wall of a building.

The glass plate 200 is installed on the window frame 100 to separate the interior and the exterior of a building. Such glass plate 200 either has a single plate, or many plates with a gap between every two of them. A structure of a window frame with two glass plates is shown in FIG. 2 and FIG. 3.

A first image expression device 300 expresses an image through the glass plate 200 installed in a window frame 100 and includes a vertical film 310, vertical winding rollers 320,330 and a first operation unit 340.

The vertical film 310 consists of multiple of the vertical film strips 311 connected in a series structure, more specifically, it consists of a multiple of the vertical first film strips 311, by connecting the upper part of a first vertical film strip 311 to the lower part of another vertical film strip 311. Each vertical film strip 311 can comprise either a transparent, semitransparent, or an opaque material, and many vertical film strips 311 do not have to be of the same material. Vertical film strips 311 with transparent material, vertical film strips 311 with semitransparent material, and vertical film strips 311 with opaque material can be used in combination to compose a vertical film 310. Also, different advertisement images and single color images can be printed on different vertical film strips 311, and among these vertical film strips 311 one of these can be chosen to be exposed to exterior through the glass plate 200.

Also, by installing solar batteries in thin film on the part of the film strip, it is possible to generate electricity when necessary.

Also by installing rear-projection screens on the part of the vertical film strip 311 and by protecting images from the inside using beam projectors on the screen, it is possible to display various videos more easily. Also it is possible to install LED in thin film or OLED in thin film on a part of vertical film strip 311.

Also, a part of vertical film strip 311 comprises an empty part 312 so that light can penetrate through vertical film strip 311 undisrupted. This empty part 312 is the same size and exterior of the glass plate or bigger. According to this structure, by locating the part of the vertical film strip 311 with this empty part to be exposed through the glass plate, it is possible to have a clear view as the normal windows.

The connection between two vertical film strips 311 can be done by various methods such as glue, glue-tape, and needlework.

Vertical winding rollers 320, 330 are connected with the vertical film 310, move vertical film 310 in the vertical direction, and are installed on the upper part frame 101 and lower part frame 102, which form window frame 100.

FIG. 4 shows a structure with the upper part frame 101 installed on a first vertical winding roller 320, the lower part frame 102 installed on the second vertical winding roller 330, the upper part of the vertical film 310 combined with the first vertical winding roller 320 to be rolled, and the lower part of the vertical film 310 combined with the second vertical winding roller 330 to be rolled. In this structure, when the upper part of the vertical film 310 is rolled into the first vertical winding roller 320, the lower part of the vertical film 310 rolled in the second vertical winding roller 330 is unrolled, and vice versa. Therefore, by adequately rolling and unrolling the vertical film 310 using vertical winding rollers 320, 330 and moving the vertical film 310 in the vertical direction, the vertical film strip 311 is arranged to be explored through the glass plate 200.

The first vertical winding roller 320 and the second vertical winding roller 330 are fixed on the window frame 100 and are combined with the installed bracket b1 with the left end and right end enabled to rotate.

A first operation unit 340 is combined with the vertical winding rollers 320, 330 to rotate the vertical winding rollers 320, 330.

This first operation unit 340 can be motor-operated using motors, or can be hand-controlled by using wires. The hand-controlled method using wire can be constituted by installing a chain wheel on the winding roller, and by allowing the wire of the chain to be rolled by the chain wheel so that the winding roller rolls to the direction of the wire pulled. Such hand-controlled method is a well-known method adapted in the widely used in window screens, so more detailed explanation is omitted.

Besides, the prior first operation unit 340 that uses motors is fixed on the window frame, and can comprise a first motor 341 and first chain 342 that delivers the rotary power by the operation of motor 341 to the first vertical winding roller 320 by connecting first motor 341 and the first vertical winding roller 320, and a second chain 343 that delivers the rotary power by the operation of the first motor 341 to the second vertical winding roller 330 by connecting the first motor 341 and the second vertical winding roller 330. Surely, a belt can be used instead of the chains 342, 343.

Besides, it is possible to install a motor 341 in each vertical winding roller 320, 330, and in this case, installation of chains 342, 343 is not required.

When the first operation unit 340 is motor-operated using a motor as described above, a control unit 500 is included for controlling the first operation unit 340 and a second operation unit 440 that will be addressed later.

The control unit 500 changes the color of the image or add animated effects on the image that is created by the overlap of the vertical film strip 311 and the horizontal film strip 411 exposed to the exterior through the glass plate 200 by controlling the first operation unit 340 and the second operation unit 440.

The second image expression device 400, just the same as the first image expression device 300, arranges image that are exposed through glass plate 200, overlaps this image on the other image arranged by the first image expression device 300 through the glass plate 200, and creates a new combined color or image, or has animated effects on the image by the combination of the two images. The aforementioned animated effects make the image seem to move by when viewed by moving the image that works as the background, or by moving the image that works as the foreground, independent from the background. Such animated effects can be achieved by appropriately controlling the first operation unit 340 and the operation unit 440. This second image expression device 400 consists of the horizontal film 410, the horizontal winding rollers 420, 430, and the second operation unit 440. The horizontal film 410 has a multiple horizontal film strips 411 connected in a series structure, more specifically, it has multiple horizontal film strips 411, by connecting the left part of one horizontal film strip 411 to the right part of another horizontal film strip 411. Each vertical film strip 411 is, a same as the horizontal film strip 311, having a transparent, semitransparent, or opaque material. On each horizontal film strip 411, a single color image or an advertisement image is printed. Also, on a part of the horizontal film strip 411, solar cell in thin film, LED in thin film, OLED in thin film can be installed, or rear-projection screens can be arranged. Also, an empty part 412 is arranged on a part of the horizontal film strip 411 in the same structure as an empty part 312 is arranged in the vertical film strip 311. Therefore, a clear view can be achieved through the window by moving the vertical film and the horizontal film to locate the empty part 312 of the vertical film 310 and the empty part 412 of the horizontal film 410 in the window frame.

The connection between the horizontal film strip 411 can be done by various methods such as glue, glue-tape, and needlework.

The horizontal film 410 as arranged above is installed in front or the rear of the vertical film 310 to overlap with the vertical film strip 311 of the vertical film 310. On FIG. 1 and FIG. 3, the structure in which the horizontal film 410 is installed in the rear of the vertical film 310 is displayed.

The horizontal winding rollers 420, 430 are connected with the horizontal film 410 to move the horizontal film 410 to left and right, and are installed on the left.

Besides, in FIG. 5, a structure in which the first horizontal winding roller 420 is installed on the left frame 103, a second horizontal winding roller 430 is installed on the right frame 104, the left side of the horizontal film 410 is connected to the first horizontal winding roller 420, and the right side of the horizontal film 410 is connected to the second horizontal winding roller is displayed.

In such structure, when the left side of the horizontal film 410 is rolled into the first horizontal winding roller 420, the right side of the horizontal film 410 is unrolled from the second horizontal winding roller 430, and when the right side of the horizontal film 410 is rolled into the second horizontal winding roller 430, the left side of the horizontal film 410 is unrolled from the first horizontal winding roller 420.

Therefore, by adequately rolling and unrolling the horizontal film 410 using the horizontal winding rollers 420,430 and moving the horizontal film 410 in the horizontal direction, the horizontal film strip 411 is arranged to be explored through the glass plate 200.

The first horizontal winding roller 420 and second horizontal winding roller 430 are fixed on the window frame 100 and are combined with the installed bracket b2 with the left end and right end enabled to rotate.

The second operation unit 340 is combined with the horizontal winding rollers 420,430 to rotate the horizontal winding rollers 420,430.

This second operation unit 440 can be composed to be, just like the aforementioned first operation unit 340, hand-controlled or motor-controlled. Besides, the prior second operation unit 340 that is motor-controlled and fixed on the window frame 100 can consist of a second motor 441, third chain 442 that delivers the rotary power by the operation of second motor 441 to the first horizontal winding roller 420 by connecting second motor 441 and the first horizontal winding roller 420, and fourth chain 443 that delivers the rotary power by the operation of the second motor 441 to the second horizontal winding roller 430 by connecting the second motor 441 and the second horizontal winding roller 430.

Surely, a belt can be used instead of the third and fourth chains 442,443. Besides, the second motor 441 can be installed in each horizontal winding roller 420,430, and in this case, the installment of third and fourth chains 442,443 is not required. This motor-controlled second operation unit 440 is controlled by the control unit 500 that was explained above.

When the first operation unit 340 and the second operation unit 440 are arranged to be motor-controlled as described above, first through sixth position markers 501, 502,503,504,505,506 and first through sixth sensors 511, 512,513,514,515,516 are included to locate the vertical film strip 311 and the horizontal film strip 411 within the window frame 100 correctly so that the image or the additional functionalities (solar batteries in thin film, a rear-projection screen, solar cell in thin film, LED in thin film, OLED in thin film can be completely exposed through the glass plate 200, and to prevent the vertical film 310 and the horizontal film 410 from getting damaged as they are excessively unrolled by the vertical winding rollers 320,330 and the horizontal winding rollers 420,430.

In this case, the first through sixth sensors 511,512,513, 514,515,516 can be constituted with photo sensors, and correspondingly the first through sixth position markers 501,502,503,504,505,506 can be constituted with a reflection board that reflect the light coming from the photo sensor to return it to the photo sensors, or can be constituted with touch-sensor such as a limited switch instead of the non-touch sensor above.

More specifically, first vertical position marker 501 comes in plurality, and each marker 501 is installed on either the left or the right side of the vertical film 310 to be placed on the center of the vertical film strip 311. The center of the vertical film strip 311 mentioned here refers to the location that corresponds to the horizontal line S1 that divides the vertical film strip 311 into upper half and lower half. In FIG. 6, a structure in which each marker 501 is installed in the right center of each vertical film strip 311 is displayed.

A first sensor 511 that corresponds to this first vertical position marker 501 is installed on the window frame 100 to recognize first vertical position marker 501 and signal when the vertical film strip 311 is located correctly for the image created by the vertical film strip 311 to be completely exposed through the glass plate 200.

Therefore, when the vertical film 310 moves vertically, the desired vertical film strip 311 controlled to be exposed through the glass plate 200 using the signal that comes from the first sensor 511.

The second vertical position marker 502 is located either on the left or the right of the vertical film 310, whichever the first vertical position marker 501 is not installed, on the upper part of the vertical film 310. In FIG. 6, a structure in which second vertical position marker 502 is installed on the upper left part of the vertical film 310 is displayed.

A second sensor 512 that corresponds to this second vertical position marker 502 is installed on the window frame 100 to recognize second vertical position marker 502 and signal when the vertical film 310 is completely unrolled from the first vertical winding roller 320.

Therefore, when the vertical film 310 is completely unrolled from the first vertical winding roller 320, it is possible to prevent the vertical film 310 from getting damaged when it is to be excessively unrolled, by stopping the rotation of the vertical winding rollers 320,330 using the signal that comes from the second sensor 512.

The third vertical position marker 503 is installed on the lower part of the vertical film 310, on the same side as second vertical position marker 502. In FIG. 6, a structure in which third vertical position marker 503 is installed on the lower left part of the vertical film 310 is displayed.

A third sensor 513 that corresponds to this third vertical position marker 503 is installed on the window frame 100 to recognize third vertical position marker 503 to signal when the vertical film 310 is completely unrolled from the second vertical winding roller 330.

Therefore, when the vertical film 310 is completely unrolled from the second vertical winding roller 330, it is possible to prevent the vertical film 310 from getting damaged when it is to be excessively unrolled, by stopping the rotation of vertical winding rollers 320,330 using the signal that comes from the third sensor 513.

First horizontal position marker 504 comes in plurality, and each first horizontal position marker 504 is installed on either the upper or the lower part of the horizontal film 410, and on the center of the horizontal film strip 411. The center of the horizontal film strip 411 mentioned here refers to the location that corresponds to the horizontal strip 411 into the left half and the right half. In FIG. 7, a structure in which first horizontal position marker 504 is installed in the upper center of each horizontal strip 411 is displayed.

A fourth sensor 514 that corresponds to this first horizontal position marker 504 is installed on the window frame 100 to recognize first horizontal position marker 504 and signal when the horizontal film strip 411 is located correctly for the image created by the horizontal film strip 411 to be completely exposed through the glass plate 200.

Therefore, when the horizontal film 410 moves horizontally, the desired horizontal film strip 411 controlled to be exposed through the glass plate 200 using the signal that comes from the fourth sensor 514.

The second horizontal position marker 505 is located either on the upper part or the lower part of the horizontal film 410, whichever the first horizontal position marker 504 is not installed, on the left part of the horizontal film 410. In FIG. 7, a structure in which second horizontal position marker 505 is installed on the lower left part of the horizontal film 410 is displayed.

A fifth sensor 515 that corresponds to this second horizontal position marker 505 is installed on the window frame 100 to recognize second horizontal position marker 505 and signal when the horizontal film 410 is completely unrolled from the first horizontal winding roller 420.

Therefore, when the horizontal film 410 is completely unrolled from the first horizontal winding roller 420, it is possible to prevent the horizontal film 410 from getting damaged when it is to be excessively unrolled, by stopping the rotation of the horizontal winding rollers 420, 430 using the signal that comes from the fifth sensor 515.

The third horizontal position marker 506 is installed on the right part of the horizontal film 410, on the same side as the second horizontal position marker 505. In FIG. 7, a structure in which the third horizontal position marker 506 is installed on the lower right part of the horizontal film 410 is displayed.

The sixth sensor 516 that corresponds to this third horizontal position marker 506 is installed on the window frame 100 to recognize third horizontal position marker 506 to signal when the horizontal film 410 is completely unrolled from the second horizontal winding roller 430.

Therefore, when the horizontal film 410 is completely unrolled from the second horizontal winding roller 430, it is possible to prevent the horizontal film 410 from getting damaged when it is to be excessively unrolled, by stopping the rotation of horizontal winding rollers 420, 430 using the signal that comes from the sixth sensor 516.

The signal that comes from the sensors 511,512,513,514, 515,516 is delivered to the control unit 500, and using this signal, the control unit 500 controls the first operation unit 340 and the second operation unit 440.

FIG. 8 shows an example that has arranged a wall of a building using the multipurpose advertisement board of the present invention.

When arranging a wall of a building using the multipurpose advertisement board as above, a multiple of multipurpose advertisement boards 100 can be arranged in a structure that each board adjoining another on the wall. A whole image can be expressed by using the multiple of the multipurpose advertisement boards by arranging them on a wall of a building.

For this purpose, the intended image has to be divided into pieces that corresponds to the number of the multipurpose advertisement boards, the vertical film strip 311 of the vertical film 310 and the horizontal film strip 411 of the horizontal film 410 is composed using the divided images, and each multipurpose advertisement board is controlled to expose the vertical film strip 311 and the horizontal film strip 411 through the glass plate 200.

In this case, an integrated controller 600 is additionally equipped to control the multiple multipurpose advertisement boards installed on the wall of the building, and this integrated controller 600 is connected to the control units 500 of each multipurpose advertisement board to control each multipurpose advertisement board.

Explanation for the Operation Effects of a Building that has a Wall Arranged by the Multipurpose Advertisement Boards of the Present Invention.

When it is judged that there is an issue with getting a clear view or getting enough sunlight coming in due to the vertical film 310 and the horizontal film 410, the vertical film and the horizontal film can be moved so that the empty parts 312,412 of the vertical film strip 311 and the horizontal film strip 411 are exposed through the glass plate 200. The vertical film 310 and the horizontal film 410 are not seen within the window frame 100, so the vertical film 310 and the horizontal film 410 prevented from disrupting the user view or blocking the sunlight. In other words, it is possible to use as a normal window.

FIG. 9 is a blueprint that shows the state of the building that has changed due to the combined image by the overlap of the vertical film 310 and the horizontal film 410.

The vertical film strip 311 and horizontal film strip 411 consist of transparent or semi-transparent material and printed difference single color Images.

As mentioned above, it is possible to express a new color by combining the two colors. Therefore, it is possible to easily change the color of the image that is expressed through the window by moving the vertical film 310 and the horizontal film 410 so that the other vertical film strip 311 and the horizontal film strip 411 of different colors are overlapped within the window frame 100, or by moving one of the vertical film 310 and the horizontal film 410 so that one of the vertical film strip 311 and the horizontal film strip 411 is changed to another film strip of another color using the control unit 500 and the operation units 340,440.

The method of expressing a new color by combining two colors has an advantage of being able to express more various colors than the method of exchanging a single color image to another color so that it can adapted to the surrounding environment or the weather more aptly.

FIG. 10 is a blueprint of a state in which the combined image has got an animated effect.

For example, have the vertical film strip 311 of the vertical film 310 that is on the front side of the window can consist of a transparent material, and print images of snow and fallen leaves.

Also, print images of nature, buildings, people or animals for background images the horizontal film strip 411 of the horizontal film 410 that is on the rear side of the window.

Move the vertical film 310 and the horizontal film 410 so that vertical film strip 311 and the horizontal film strip 411 arranged as above are correctly located within the window frame 100. Then, while the horizontal film 410 is fixed, by moving the vertical film 310 down, effects of snow and leaves falling and effects of a changes in seasons can be expressed. Since the duration of the effect is proportional to the amount of the number of printed vertical film strip 311 with snow or leaves images, by having an appropriate number of film strips, it is possible to determine the duration of the effects.

Likewise, by printing images of nature on horizontal film strip 411 and having vertical film strip 311 fixed, it is possible to achieve an effect of images of vertical film strip 311 moving by only moving the horizontal film strip 411.

The present invention has been explained above with reference to embodiments thereof, but the present invention is not limited to the above-described embodiments. In concluding the detailed description, those skilled in the art will appreciate that many variations and modifications can be made to the preferred embodiments without departing from the principles of the present invention. Therefore, it will be readily understood that such variations and modifications to the preferred embodiment are within the scope of the present invention as in the claims.

REFERENCE NUMBERS

100: window frame
101: upper frame
102: lower frame
103: left frame
104: right frame
200: window glass
300: first image expression device
310: vertical film
311: vertical film strip
312: empty part
320: vertical winding roller
330: vertical winding roller
340: first operation unit
400: second image expression device
410: horizontal film
411: horizontal film strip
412: empty part
420: first horizontal winding roller
430: second horizontal winding roller
440: second operation unit
500: control unit
501: first vertical position marker
502: second vertical position marker
503: third vertical position marker
504: first horizontal position marker
505: second horizontal position marker
506: third horizontal position marker
511: first sensor, a first vertical position sensor.
512: second sensor, a second vertical position sensor.
513: third sensor, a third vertical position sensor.
514: fourth sensor, a first horizontal position sensor.
515: fifth sensor, a second horizontal position sensor.

516: sixth sensor, a third horizontal position sensor
600: integrated controller

What is claimed is:

1. A multipurpose advertisement board comprising:

a window frame with more than one installed glass plate;

a vertical film comprising multiple film strips connected in series, wherein one of the multiple film strips comprises an empty strip equal to or larger than the glass plates to allow light to pass through without disruption;

a first image expression device comprising an operating unit rotatably connected to a vertical winding roller in upper and lower portions of the window frame that vertically moves the vertical film to display the multiple film strips in the series;

a horizontal film comprising multiple film strips connected in series, wherein one of the multiple film strips of the horizontal film comprises an empty strip equal to or larger than the glass plates to allow light to pass through without disruption; and a second image expression device comprising an operation unit rotatably connected to a horizontal winding roller installed in left and right portions of the window frame to rotate or release the horizontal film, thereby horizontally moving the horizontal film so that one of the multiple film strips of the horizontal film overlap with one of the multiple film strips of the vertical film to make a combined image.

2. The multipurpose advertisement board of claim 1, wherein each operation unit is a motor-controlled unit that delivers rotary power to rotate the winding roller, the multipurpose advertisement board further comprising a control unit that controls the operation units to change the color of the combined image or to add animated effects on the combined image by changing either or both of the film strips that overlap.

3. The multipurpose advertisement board of claim 2, further comprising:

a first vertical position marker installed vertically at a center of each vertical film strip and horizontally at either the left or the right of the vertical film;

a second vertical position marker installed on the upper part of the vertical film, and horizontally opposite to the first vertical position marker;

a third vertical position marker installed on the lower part of the vertical film and on the same horizontal side as the second vertical position marker;

a first vertical sensor that signals when it recognizes the first vertical position marker at a predetermined location within the window frame;

a second vertical sensor that signals when it recognizes the second vertical position marker at a lower portion of the window frame as the vertical film is completely unrolled by the vertical winding roller nearest the lower part of the window frame;

a third vertical sensor that signals when it recognizes the third vertical position marker at an upper portion of the window frame as the vertical film is completely unrolled by the vertical winding roller nearest the upper part of the window frame;

a first horizontal position marker installed horizontally at the center of each horizontal film strip and vertically at the upper or the lower part of the horizontal film;

a second horizontal position marker installed on a left side of the horizontal film and vertically opposite to the first horizontal position marker;

a third horizontal position marker installed on a right side of the horizontal film and vertically on a same side as the second horizontal position marker;

a first horizontal sensor that signals when it recognizes the first horizontal position marker is at a predetermined location within the window frame;

a second horizontal sensor that recognizes the second horizontal sensor as the horizontal film is completely unrolled by the horizontal winding roller located nearest the right side of the window frame; and a third horizontal sensor that signals when it recognizes the third horizontal sensor as the horizontal film is completely unrolled by the horizontal winding roller nearest the left side of the window frame.

4. A building comprising a wall arranged by a plurality of multipurpose advertisement boards of claim 1, wherein the plurality of multipurpose advertisement boards express one whole image created by many images, each expressed by a different multipurpose advertisement board, and wherein the building further comprises an integrated controller that controls the image expressed by the multiple multipurpose advertisement boards by controlling each of the multiple multipurpose advertisement boards.

* * * * *